US007918692B1

(12) United States Patent
Hertzler et al.

(10) Patent No.: US 7,918,692 B1
(45) Date of Patent: Apr. 5, 2011

(54) ELECTRICAL TERMINAL BLOCKS AND ASSEMBLIES THEREOF

(75) Inventors: Christopher Scott Hertzler, Carlisle, PA (US); Bernard Paul Rush, Baldwinsville, NY (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/576,539

(22) Filed: Oct. 9, 2009

(51) Int. Cl.
*H01R 9/22* (2006.01)

(52) U.S. Cl. ..... 439/712; 439/810

(58) Field of Classification Search ..... 439/460, 439/712, 717, 718, 810
See application file for complete search history.

(56) References Cited

U.S. PATENT DOCUMENTS

| | | | | |
|---|---|---|---|---|
| 4,089,612 | A | 5/1978 | Mazzeo | |
| 4,180,305 | A | 12/1979 | Ustin et al. | |
| 4,637,676 | A * | 1/1987 | Simonsen et al. | 439/488 |
| 5,044,962 | A | 9/1991 | Tomes et al. | |
| 7,413,449 | B1 | 8/2008 | Su et al. | |
| 7,462,063 | B1 | 12/2008 | Correll | |
| 7,559,810 | B1 * | 7/2009 | Wu | 439/801 |

* cited by examiner

*Primary Examiner* — Khiem Nguyen

(57) ABSTRACT

An electrical terminal block including a mating face and a loading surface that are spaced apart from each other along a longitudinal axis. The mating face extends along a lateral axis. The terminal block also includes first and second sidewalls that face in opposite directions and extend between the mating face and the loading surface. Each of the first and second sidewalls includes a wing member that projects therefrom along the lateral axis and a recess configured to receive a wing member from another terminal block. The wing members and the recesses have matching complementary cross-sections taken along the longitudinal axis such that the wing member on the first sidewall of one terminal block is slidably and securely received within the recess on the second sidewall of another terminal block.

19 Claims, 5 Drawing Sheets

ELECTRICAL TERMINAL BLOCKS AND ASSEMBLIES THEREOF

BACKGROUND OF THE INVENTION

The invention relates generally to electrical connectors and, more particularly to terminal blocks for interconnecting electrical wires or conductors.

Terminal blocks may be used in electrical systems and devices to interconnect electrical conductors for transmitting power or electrical signals therethrough. In conventional terminal blocks, a first array of electrical wires may be inserted through one side of an insulative housing where the electrical wires of the first array engage conductive pathways in the housing. A second array of electrical wires may also engage the conductive pathways through another side of the housing. As such, each conductive pathway may transmit an electrical current between two interconnected electrical conductors.

The insulative housing of the conventional terminal blocks may be constructed by two or more different housing components. Prior to assembly, electrical contacts may be inserted into or formed with the housing components. The housing components may then be coupled together to form the terminal block. For example, one housing component may have flexible outer latches that extend along a side of the housing component. The outer latches may be configured to grip or couple to an exterior surface of the other housing component.

However, the outer latches may limit the usefulness of such terminal blocks. Terminal blocks are frequently used in electrical systems or devices with limited available space. The outer latches may require additional space or may use space that would otherwise be available for interconnecting the electrical conductors. Furthermore, the terminal blocks may be unable to couple to each other end-to-end due to the outer latches. Another problem with some known terminal blocks is that the assembly of the terminal blocks may be complex and require several parts. This may lead to increased costs for manufacturing and assembling the terminal blocks.

Accordingly, there is a need for terminal blocks that require less space and are less costly to manufacture than known terminal blocks. There is also a need for terminal blocks that may be coupled together end-to-end to form a terminal block assembly.

BRIEF DESCRIPTION OF THE INVENTION

In accordance with one embodiment, an electrical terminal block is provided that is oriented with respect to longitudinal and lateral axes that extend perpendicular to each other. The terminal block includes a mating face and a loading surface that are spaced apart from each other along the longitudinal axis. The mating face extends along the lateral axis. The mating face and the loading surface are configured to engage respective electrical conductors. The terminal block also includes first and second sidewalls that face in opposite directions and extend between the mating face and the loading surface. Each of the first and second sidewalls includes a wing member that projects therefrom along the lateral axis and a recess configured to receive a wing member from another terminal block. The wing members and the recesses have matching complementary cross-sections taken along the longitudinal axis such that the wing member on the first sidewall of one terminal block is slidably and securely received within the recess on the second sidewall of another terminal block.

In accordance with another embodiment, an electrical terminal block oriented with respect to longitudinal and lateral axes that extend perpendicular to each other is provided. The terminal block includes a mating face and a loading surface that are spaced apart from each other along the longitudinal axis. The mating face extends along the lateral axis. The terminal block also includes first and second housing shells that have first and second coupling sides, respectively. The first and second coupling sides extend between the mating face and the terminal end. Each of the first and second housing shells have contact cavities that extend from the mating face and along the longitudinal axis. The contact cavities are spaced apart along the lateral axis and are configured to receive corresponding electrical conductors. The second housing shell has interior walls that extend along the longitudinal axis between the contact cavities of the second housing shell. The terminal block also includes bores that extend from the coupling side of the second housing shell and into corresponding interior walls. The terminal block also includes locking pins that project from the coupling side of the first housing shell. The first and second coupling sides mate with each other along an interface when the first and second housing shells are coupled together. The locking pins are inserted into and form interference fits with corresponding bores. The interference fits combine to form a rigid connection that mechanically holds the first and second housing shells together.

In accordance with yet another embodiment, an electrical terminal block assembly is provided that includes first and second terminal blocks. Each of the first and second terminal blocks includes a mating face and a loading surface that are spaced apart from each other along the longitudinal axis. The mating face extends along the lateral axis. The mating face and the loading surface are configured to engage respective electrical conductors. Each of the first and second terminal blocks also includes first and second sidewalls that face in opposite directions and extend between the mating face and the loading surface. Each of the first and second sidewalls includes a wing member that projects therefrom along the lateral axis and a recess configured to receive a wing member from another terminal block. The wing members and the recesses have matching complementary cross-sections taken along the longitudinal axis. The wing member of the first sidewall of the first terminal block is slidably and securely received within the recess of the second sidewall of the second terminal block.

DETAILED DESCRIPTION OF THE INVENTION

Figure 1:
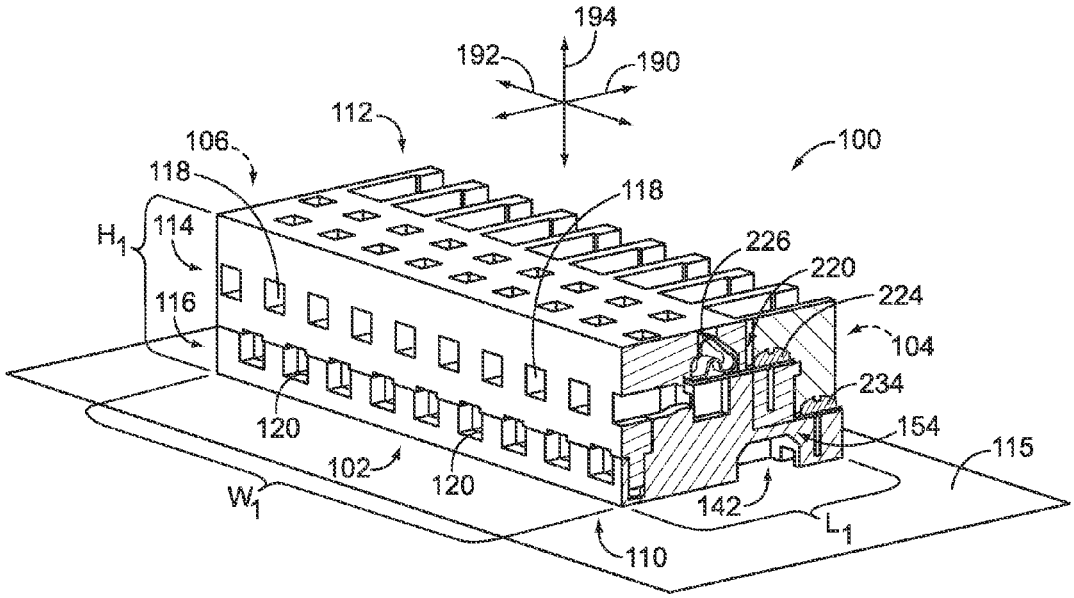
FIG. 1 is a front perspective view of a terminal block formed in accordance with one embodiment and includes a cross-section of the terminal block.
Figure 2:
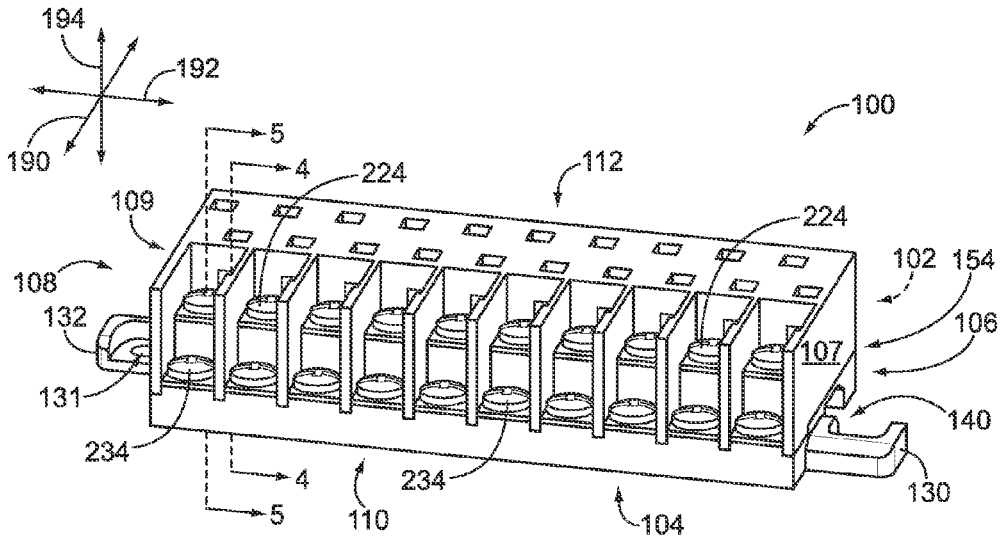
FIG. 2 is a rear perspective view of the terminal block shown in FIG. 1.

FIGS. 1 and 2 are front and rear perspective views of a terminal block 100 formed in accordance with one embodiment. FIG. 1 also illustrates a cross-section of the terminal block 100. The terminal block 100 is oriented with respect to a longitudinal axis 190, a lateral axis 192, and a vertical or elevational axis 194. As shown, the terminal block 100 has a wire mating face 102 and a terminal loading surface 104 that are spaced apart from each other along the longitudinal axis 190. The mating face 102 may also be referred to as a wire mating side, and the loading surface 104 may also be referred to as a loading end. The mating face 102 and the loading surface 104 extend substantially along the lateral axis 192 (i.e., extend substantially in a direction of the lateral axis 192). The terminal block 100 also includes first and second sidewalls 106 and 108 (FIG. 2) that extend parallel to the longitudinal axis 190 and each other between the mating face 102 and the loading surface 104. The sidewalls 106 and 108 face in opposite directions with respect to each other. The terminal block 100 also includes a mounting side 110 and a top side 112 that are spaced apart along the vertical axis 194. The mounting side 110 and the top side 112 may extend parallel to the longitudinal and lateral axes 190 and 192 and between the mating face 102 and the loading surface 104. The mounting side 110 is configured to be mounted to and interface with a base structure 115 (FIG. 1). The base structure 115 may be, for example, an electrical component (not shown), such as a circuit board or a housing of an electrical device.

The terminal block 100 may be used to interconnect electrical conductors 262 (shown in FIG. 6) that engage the mating face 102 with electrical conductors 260 (shown in FIG. 6) that engage the loading surface 104. In some embodiments, the terminal block 100 may be coupled end-to-end with another terminal block to form a terminal block assembly, such as a terminal block assembly 300 shown in FIG. 7. Also, in some embodiments, the terminal block 100 may have a reduced spatial volume or cover a reduced area along the base structure 115 as compared to known terminal blocks. Furthermore, in some embodiments, the terminal block 100 may be formed from separate housing shells that may, for example, be assembled in a simpler manner than know terminal blocks.

As shown in FIG. 1, the terminal block 100 may include rows 114 and 116 of contact cavities 118 and 120, respectively. The contact cavities 118 and 120 of each row 114 and 116, respectively, may be spaced apart from each other along the lateral axis 192. In the exemplary embodiment, the contact cavities 118 and 120 are evenly distributed along each corresponding row. The contact cavities 118 and 120 may include contact assemblies 220 and 230 (shown in FIG. 5) that include spring clips 226 and 236 (shown in FIG. 5), respectively. The contact assemblies 220 and 230 may include, for example, respective threaded fasteners 224 and 234. When in operation, the electrical conductors 262 may engage the mating face 102 and be inserted into the contact cavities 118 and 120. The electrical conductors 262 may electrically connect to the contact assemblies 220 and 230 therein. Furthermore, the electrical conductors 260 may engage the loading surface 104 and electrically connect to the contact assemblies 220 and 230 through the respective threaded fasteners 224 and 234.

Also shown with respect to FIG. 1, the terminal block 100 may have a width $W_1$ that extends along the lateral axis 194 between the sidewalls 106 and 108, a length $L_1$ that extends along the longitudinal axis 190 between the mating face 102 and the loading surface 104, and a height $H_1$ that extends along the vertical axis 194 between the mounting side 110 and the top side 112. As shown, at least one of the sidewalls 106 and 108 may extend entirely from the mating face 102 to the loading surface 104.

With respect to FIG. 2, the sidewalls 106 and 108 have side surfaces 107 and 109, respectively. The sidewall 106 may include a wing member 130 that projects away from the side surface 107 along the lateral axis 192 and a recess 140 that extends from the side surface 107 into the terminal block 100 along the lateral axis 192. Likewise, the sidewall 108 may include a wing member 132 that projects away from the side surface 109 along the lateral axis 192 and a recess 142 (FIG. 1) that extends from the side surface 109 into the terminal block 100 along the lateral axis 192.

The wing members 130 and 132 are sized and shaped to be inserted into recesses (not shown) of other terminal blocks (not shown), and the recesses 140 and 142 are sized and shaped to receive wing members (not shown) from the other terminal blocks. More specifically, the wing members 130 and 132 may have matching complementary cross-sections taken along the longitudinal axis 190. Optionally, the wing members 130 and 132 may be shaped to engage a fastener to attach the terminal block 100 to the base structure 115. For example, the wing members 130 and 132 may have openings 131 for receiving a threaded fastener, plug, bolt, and the like.

As shown, the wing member 130 and the recess 140 have a common axial position along the vertical axis 194. However, the wing member 130 and the recess 140 may have different axial positions along the longitudinal axis 190. For example, the wing member 130 and the recess 140 may be directly adjacent to one another. The wing member 132 and the recess 142 may have similar vertical and longitudinal axial positions with respect to each other as the wing member 130 and the recess 140.

Figure 3:
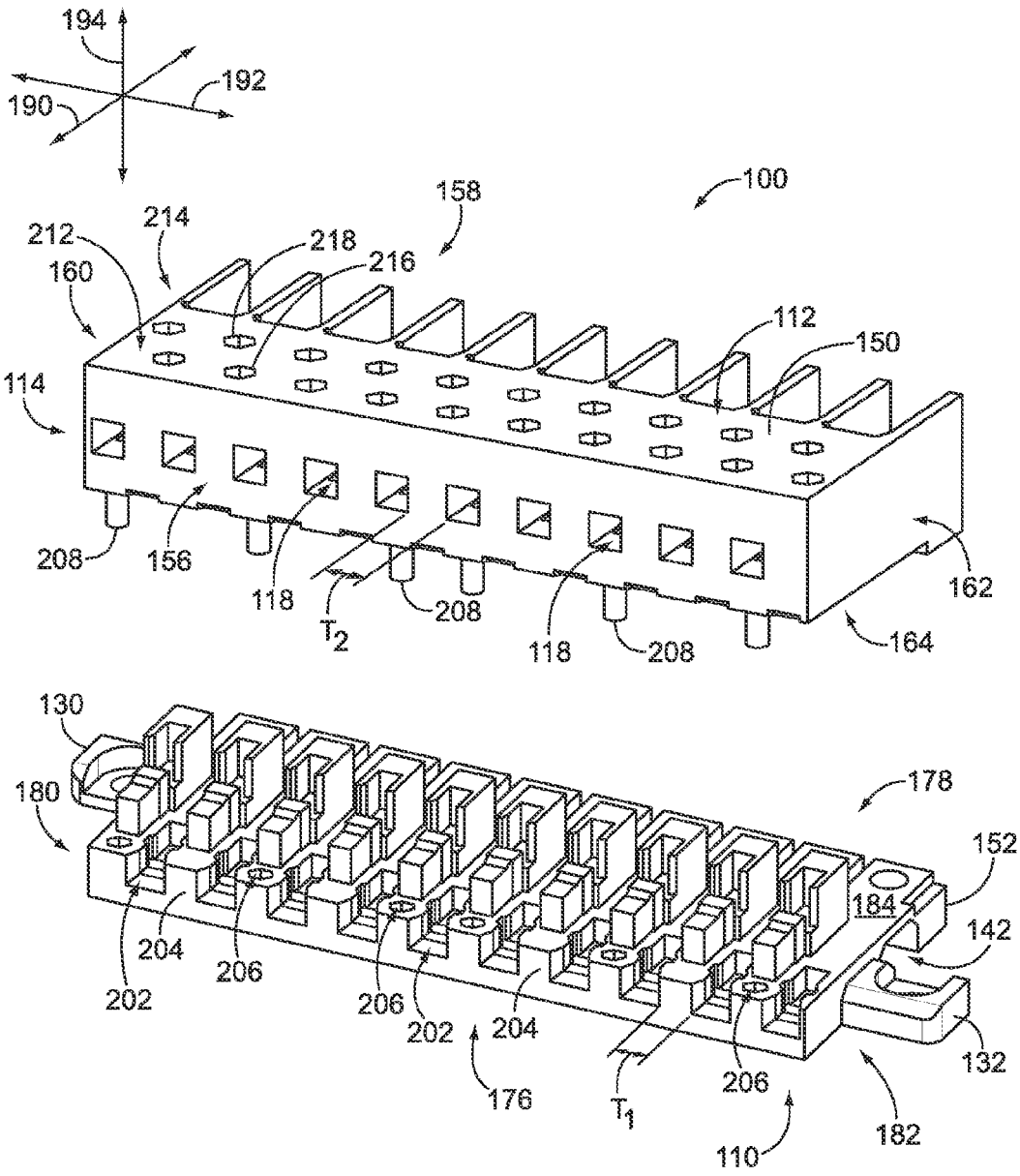
FIG. 3 is an exploded front perspective view of the terminal block shown in FIG. 1.

FIG. 3 is an exploded front perspective view of the terminal block 100. As described above, the terminal block 100 may be formed from separate first and second housing shells 150 and 152 that are mated together along an interface 154 (shown in FIGS. 1 and 2). However, in alternative embodiments, the features described herein of the housing shells 150 and 152 may be integrally formed into a single piece (e.g., through a molding process). The housing shell 150 includes front and back ends 156 and 158 that are spaced apart along the longitudinal axis 190 and a pair of sides 160 and 162 that are spaced apart along the lateral axis 192. The housing shell 150 may also include a coupling side 164 and the top side 112 that are spaced apart along the vertical axis 194. Similarly, the housing shell 152 includes front and back ends 176 and 178 that are spaced apart along the longitudinal axis 190 and a pair of sides 180 and 182 that are spaced apart along the lateral axis 192. The housing shell 152 may also include a coupling side 184 and the mounting side 110 that are spaced apart along the vertical axis 194. The housing shells 150 and 152 are configured to be coupled together such that the coupling sides 164 and 184 engage each other along the interface 154. In the exemplary embodiment, the housing shell 150 is mounted onto the housing shell 152.

In the illustrated embodiment, the housing shell 152 includes the wing members 130 and 132 and the respective recesses 140 (FIG. 2) and 142. The housing shell 152 also includes a plurality of contact channels 202 that extend along the longitudinal axis 190. The contact channels 202 are open-sided channels that open to the coupling side 184 and form the contact cavities 120 when the housing shell 150 is mounted onto the housing shell 152. The housing shell 152 also includes interior walls 204 that extend along the longitudinal axis 190 between corresponding contact channels 202. In the illustrated embodiment, each interior wall 204 separates adjacent contact channels 202.

Moreover, at least one interior wall 204 may have a bore 206 that extends from the coupling side 184 into the interior wall 204 along the vertical axis 194. The bores 206 may be located proximate to the front end 176 of the housing shell 152. In the exemplary embodiment, the housing shell 152 includes a plurality of bores 206 that extend into respective interior walls 204. However, in alternative embodiments, the housing shell 152 may include only one bore 206. Also shown, each interior wall 204 has a thickness $T_1$ taken along the lateral axis 192. The thickness $T_1$ may be greater near the front end 176 and reduce or lessen as the interior wall 204 extends longitudinally toward the back end 178. The thickness $T_1$ may be at least large enough to form the bore 206 therein.

Also shown in FIG. 3, the housing shell 150 includes the row 114 of the contact cavities 118. The contact cavities 118 may be separated from each other by interior walls 210 that have a thickness $T_2$. In the exemplary embodiment, the contact cavities 118 are evenly spaced apart along the lateral axis 192. However, in alternative embodiments, the contact cavities 118 may have different spacings. Although not shown in FIG. 3, the contact cavities 118 may be exposed through or open to the coupling side 164. However, in alternative embodiments, the contact cavities 118 may be completely enclosed or defined by the material of the housing shell 150.

Also shown, the housing shell 152 may include a plurality of locking pins 208 that project away from the coupling side 164 along the vertical axis 194. In the illustrated embodiment, the locking pins 208 are vertically aligned (i.e., aligned along the vertical axis 194) with corresponding contact cavities 118 and extend directly away from the corresponding contact cavities 118. The locking pins 208 are shown as cylindrical posts. However, the locking pins 208 may have other shapes. Furthermore, the locking pins 208 may be located proximate to the front end 156 of the housing shell 150.

The top side 112 may include rows 212 and 214 of passages 216 and 218, respectively. The passages 216 and 218 extend from the top side 112 along the vertical axis 194 toward the coupling side 164. The passages 216 and 218 extend to the contact cavities 120 and 118, respectively. More specifically, when the terminal block 100 is fully assembled, the passages 216 are vertically aligned with corresponding contact cavities 120 (FIG. 1), and the passages 218 are vertically aligned with corresponding contact cavities 118. The passages 216 and 218 provide access for a tool to engage the spring clips 226 and 236.

Figure 4:
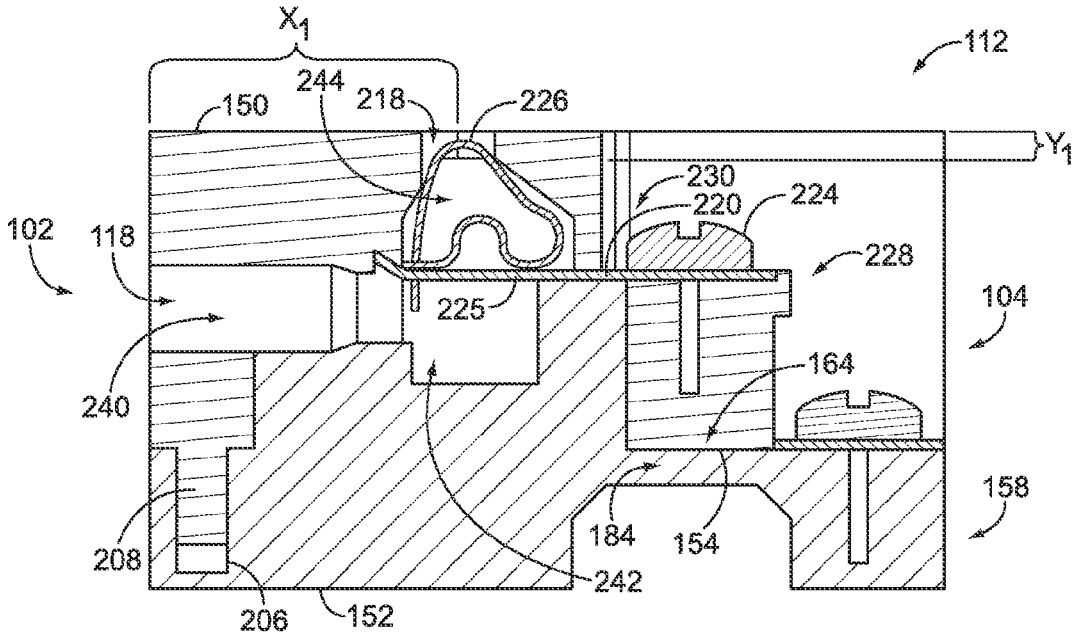
FIG. 4 is a cross-section of the terminal block taken along the line 4-4 shown in FIG. 2.
Figure 5:
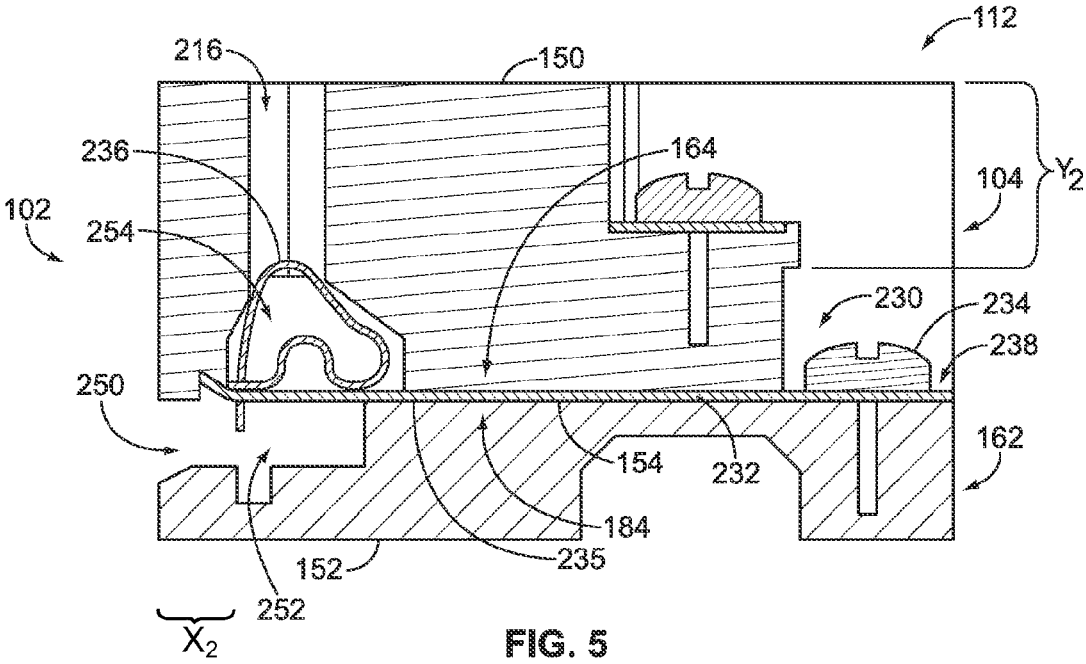
FIG. 5 is a cross-section of the terminal block taken along the line 5-5 shown in FIG. 2.

FIGS. 4 and 5 are cross-sectional views of the terminal block 100 taken along the line 4-4 and 5-5, respectively, shown in FIG. 2. With respect to FIG. 4, the contact assembly 220 may include a contact body 222, a threaded fastener 224, and the spring clip 226. With respect to FIG. 5, the contact assembly 230 may also include a contact body 232, a threaded fastener 234, and the spring clip 236. The contact bodies 222 and 232 provide conductive pathways that extend between the loading surface 104 and the mating face 102. The contact bodies 222 and 232 may have respective terminating ends 228 (FIG. 4) and 238 (FIG. 5) and respective arms 225 (FIG. 4) and 235 (FIG. 5). The arms 225 and 235 extend lengthwise from the terminating ends 228 and 238, respectively, toward the mating face 102 of the terminal block 100. The arms 225 and 235 may extend into the respective contact cavities 118 and 120 where the arms 225 and 235 may engage and cooperate with the spring clips 226 and 236, respectively, to establish an electrical connection with a corresponding electrical conductor.

In the illustrated embodiment, the contact assemblies 220 and 230 are coupled to the housing shells 150 and 152, respectively, prior to the housing shells 150 and 152 being coupled together. More specifically, the arm 225 of the contact body 222 may be positioned alongside the coupling side 164 and the terminating end 228 may be secured to the housing shell 150 proximate to the back end 158. Similarly, the arm 235 of the contact body 232 may be positioned alongside the coupling side 184 and the terminating end 238 may be secured to the housing shell 152 proximate to the back end 158. When the housing shells 150 and 152 are coupled together, the coupling side 164 of the housing shell 150 is mounted to the coupling side 184 of the housing shell 152. The coupling sides 164 and 184 engage each other along the interface 154 such that the contact bodies 222 and 232 extend between the housing shells 150 and 152 along the interface 154. More specifically, the contact bodies 222 and 232 may be sandwiched between the housing shells 150 and 152.

As shown in FIG. 4, the contact cavity 118 includes a conductor portion 240, an engagement portion 242, and a clip portion 244 that may be accessed by the passage 218. The conductor portion 240 extends lengthwise along the longitudinal axis 190 and is sized and shaped to receive a corresponding electrical conductor. The clip portion 244 is sized and shaped to receive and hold the spring clip 226 therein. The passage 218 may extend along the vertical axis 194 (FIG. 1) and may be sized and shaped to receive a tool (e.g., a rod or bar) configured to engage the spring clip 226. Likewise, as shown in FIG. 5, the contact cavity 120 includes a conductor portion 250, an engagement portion 252, and a clip portion 254 that may be accessed by the passage 216. The conductor portion 250 is sized and shaped to receive a corresponding electrical conductor and provides access to the engagement portion 252. The clip portion 254 is sized and shaped to receive and hold the spring clip 236 therein. The passage 216 may be sized and shaped to receive a tool configured to engage the spring clip 236.

To mount the housing shell 150 to the housing shell 152, the locking pins 208 (FIG. 4) are inserted into the bores 206 (FIG. 4) and form an interference fit therewith. In the exemplary embodiment, the locking pins 208 have circular cross-sections and the bores 206 have hexagonal cross-sections to facilitate forming the interference fit. The interference fits formed between the corresponding locking pins 208 and bores 206 combine to form a rigid connection that mechanically holds the housing shells 150 and 152 together in a unitary structure. For example, the rigid connection may hold the housing shells 150 and 152 such that gravitational force alone could not separate the housing shells 150 and 152 (i.e., the rigid connection may support a weight of either housing shell). More specifically, a substantial separating force that is significantly greater than the gravitational force along the vertical axis 194 may be required to separate the housing shells 150 and 152 after the housing shells 150 and 152 are coupled to each other. In some embodiments, an adhesive may be used in addition to the locking pins 208 and the bores 206.

In the exemplary embodiment, the coupling sides 164 and 184 of the housing shells 150 and 152 include uneven surfaces having recesses or cavities that are sized and shaped to form the portions of the contact cavities 118 and 120 when the housing shells 150 and 152 are coupled together. More specifically, the housing shell 150 may include the passages 218 and 216 and recesses that form the clip portions 244 and 254.

The housing shell 150 may also include the conductor portion 240 when the housing shells 150 and 152 are mated together along the interface 154. The coupling side 164 may form an inner wall or surface of the conductor portion 250. Similarly, the housing shell 152 may include recesses that form the conductor portion 250 and the engagement portion 252. The coupling side 184 may form an inner wall or surface of the conductor portion 240.

Also shown, the contact cavities 118 and 120 may extend different longitudinal distances X1 and X2, respectively, into the terminal block 100 from the mating face 102, and the passages 218 and 216 may extend different vertical distances Y1 and Y2 from the top side 112. In such embodiments the different longitudinal distances X1 and X2 and vertical distances Y1 and Y2 may allow the contact cavities 118 and 120 to be more tightly packed or arranged with respect to each other.

Accordingly, in some embodiments, the terminal block 100 may not utilize fastening elements along the sidewalls 106 and 108 (FIGS. 1 and 2), such as clips, threaded fasteners, tabs, and the like, in order to couple the housing shells 150 and 152 together. In more particular embodiments, the rigid connection holding the housing shells 150 and 152 together is only formed by the interference fits between the bores 206 and the locking pins 208.

Figure 6:
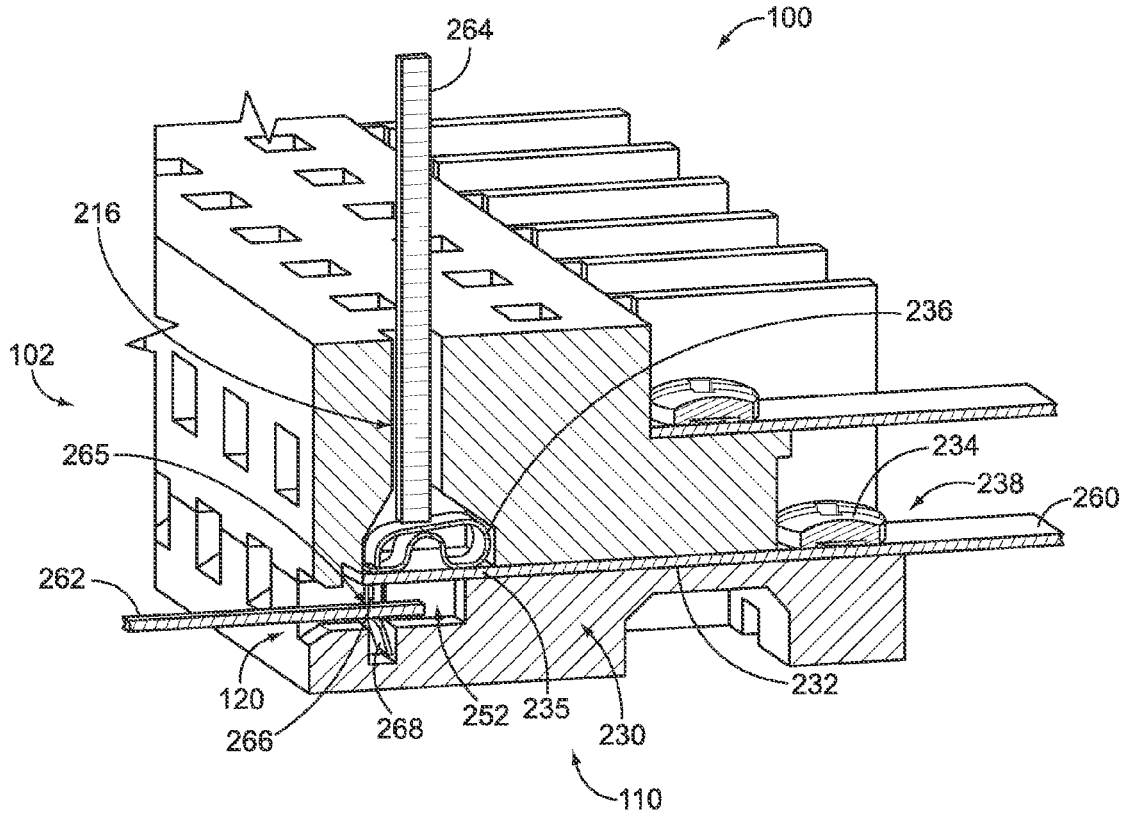
FIG. 6 is a cross-sectional view of a contact assembly having a flexed spring clip within the terminal block of FIG. 1.

FIG. 6 is a cross-sectional view of the terminal block 100 when the contact assembly 230 is electrically connected to an electrical conductor 260 at the terminating end 238. By way of example, the threaded fastener 234 may be loosened and the conductor 260 may be inserted between the threaded fastener 234 and the terminating end 238 of the contact body 232. The threaded fastener 234 may then be tightened to secure the conductor 260 to the terminating end 238 and establish an electrical connection between the conductor 260 and the contact assembly 230.

To establish an electrical connection between the contact assembly 230 and an electrical conductor 262 inserted through the mating face 102, a tool 264 may be inserted through the passage 216 to engage the spring clip 236. The spring clip 236 may have a flexible finger 266 that is configured to be compressed toward the arm 235 of the contact body 232. The flexible finger 266 may have an opening 265 where the arm 235 extends therethrough. In the unengaged position (shown in FIG. 5), the flexible finger 266 is biased against the contact body 232. An end 268 of the flexible finger 266 may prevent or block access to the engagement portion 252 of the contact cavity 120. When the flexible finger 266 is engaged, the end 268 moves away from the contact body 232 toward the mounting side 110 thereby allowing access to the engagement portion 252 through the opening 265. When the spring clip 236 is engaged, the end 268 does not interfere with insertion of the electrical conductor 262 due to a shape, a free floating state, and interference with the cavity wall. After the electrical conductor 262 has been fully inserted, the spring clip 236 may be disengaged such that the flexible finger 266 returns to the biased position. The conductor 262 may then be compressed into the arm 235 of the contact body 232. As such, an electrical connection may be established with conductors 262 inserted into the contact cavity 120 through the mating face 102.

Figure 7:
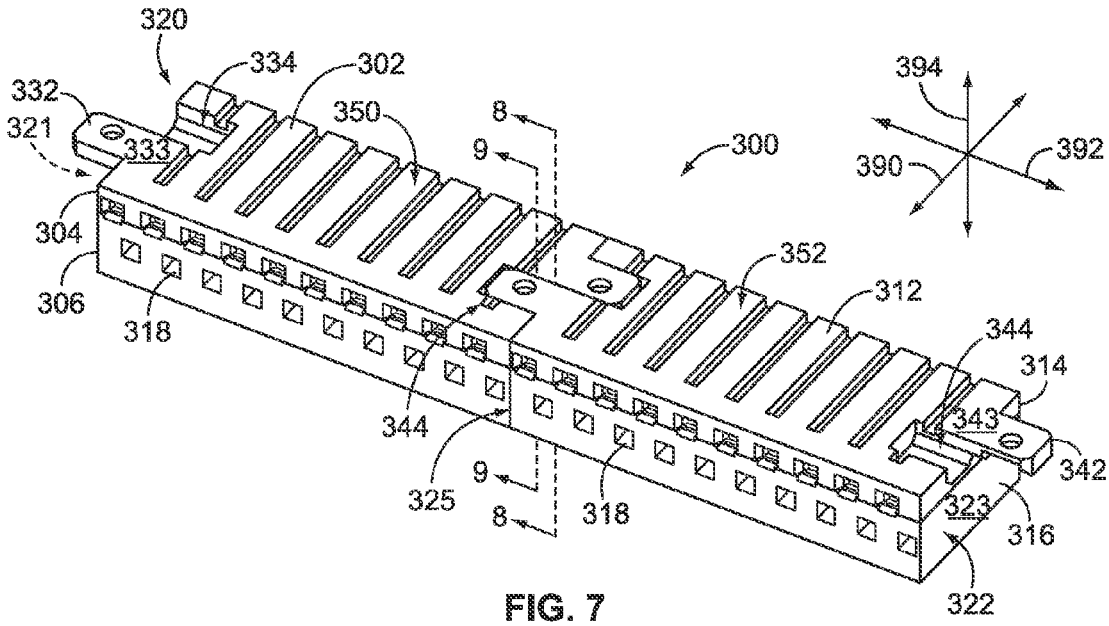
FIG. 7 is a bottom perspective view of a terminal block assembly formed in accordance with one embodiment.

FIG. 7 is a front perspective view of a terminal block assembly 300 formed in accordance with one embodiment. The block assembly 300 includes first and second terminal blocks 302 and 312, which may have similar features and components as the terminal block 100. For example, the terminal block 302 may be formed from separate housing shells 304 and 306, and the terminal block 312 may be formed from separate housing shells 314 and 316. The housing shells 304 and 314 may be substantially identical to each other and may have similar features as the housing shell 152 (FIG. 3). Likewise, the housing shells 306 and 316 may be substantially identical to each other and may have similar features as the housing shell 150 (FIG. 3).

In accordance with some embodiments, the terminal blocks 302 and 312 may be configured to be coupled end-to-end to each other. More specifically, the terminal blocks 302 and 312 may each have first and second sidewalls 320 and 322. (The first and second sidewalls 320 and 322 of the terminal blocks 312 and 302, respectively, are mated together along an interface 325 in FIG. 7.) The first and second sidewalls 320 and 322 may have complementary shapes configured to mate with each other. More specifically, the first sidewalls 320 may have a side surface 321 and include a wing member 332 that projects away from the side surface 321. The first sidewalls 320 may also have corresponding recesses 334 that project into the corresponding terminal block. Similarly, the second sidewalls 322 may have a side surface 323 and include a wing member 342 that projects away from the side surface 323. The second sidewalls 322 may also have corresponding recesses 344 that project into the corresponding terminal block. The side surfaces 321 and 323 of the same terminal block face in opposite directions. The first and second side surfaces 321 and 323 may be substantially planar.

Furthermore, the terminal blocks 302 and 312 may have respective mounting sides 350 and 352. In some embodiments, the wing members 332 and 342 may have surfaces 333 and 343 that are coplanar with the mounting sides 350 and 352, respectively. Accordingly, when the terminal blocks 302 and 312 are coupled together, the mounting sides 350 and 352 and the surfaces 333 and 343 may form one continuous, level surface that interfaces with a base structure (not shown).

Figure 8:
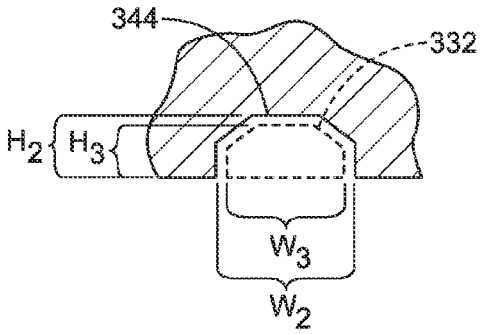
FIG. 8 is a cross-sectional view of a wing member within a recess taken along a line 8-8 shown in FIG. 7.
Figure 9:
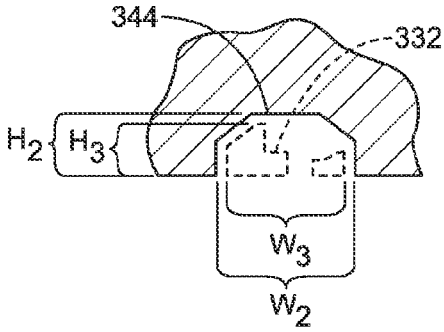
FIG. 9 is a cross-sectional view of a wing member within a recess taken along a line 9-9 shown in FIG. 7.

FIGS. 8 and 9 illustrate cross-sectional views of the wing member 332 and the recess 344 that are taken along a longitudinal axis 390. The recesses 344 may be sized and shaped to slidably and securely receive the corresponding wing members 332. For example, as shown in FIG. 8, the wing member 332 and the recess 344 may have matching complementary cross-sections taken along the longitudinal axis 390 such that the wing member 332 is slidably and securely received within the recess 344.

In some embodiments, a cross-section of the wing member 332 taken along the longitudinal axis 390 may be substantially equal in size and shape to a cross-section of the recess 344. As used herein, a cross-section of a wing member is "substantially equal in size and shape" to a cross-section of a recess if at least a portion of the cross-section of the wing member has a height H that is substantially equal to a height H of the cross-section of the recess and if at least a portion of the cross-section of the wing member has a width W that is substantially equal to a width W of the cross-section of the recess. For example, as shown in FIGS. 8 and 9, at least a portion of the wing member 332 has a height $H_3$ that is substantially equal to a height $H_2$ of the recess 344 and at least a portion of the wing member 332 has a width $W_3$ that is substantially equal to a width $W_2$ of the recess 344. Also shown in FIG. 9, the wing member 332 may have reduced portions to provide space for a threaded fastener (not shown) to secure the terminal block to the base structure.

To construct the block assembly 300, the terminal blocks 302 and 312 may be fully constructed before inserting the wing member 332 into the recess 344. Alternatively, the housing shells 304 and 314 may be mated together and secured to a base structure before the housing shells 306 and 316 are mounted thereon, respectively. Accordingly, the wing member 332 of the sidewall 320 of the terminal block 312 and the recess 344 of the sidewall 322 of the terminal block 302 may be sized and shaped to form a snug or clearance fit. As such, the terminal blocks 302 and 312 cannot be rotated about a vertical axis 394 that extends perpendicular to the longitudinal axis 390 and a lateral axis 392. As shown, when the terminal blocks 302 and 312 are coupled end-to-end, the contact cavities 368 and 370 may have a continuous alternating relationship where the spacings between the contact cavities 368 and 370 along the lateral axis 392 are not disrupted or changed by the multiple terminal blocks.

Although the block assembly 300 only includes two terminal blocks 302 and 312, other embodiments may include more than two terminal blocks. Since the terminal blocks may have identical features, any of the terminal blocks in the block assembly may be a first or last terminal block and any of the terminal blocks may be middle or intermediary terminal blocks. The wing members of the first and/or last terminal blocks may be secured to the base structure by a fastener.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the specific components and processes described herein are intended to define the parameters of the various embodiments of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical terminal block oriented with respect to longitudinal and lateral axes that extend perpendicular to each other, the terminal block comprising:

a mating face and a loading surface being spaced apart from each other along the longitudinal axis and being configured to engage respective electrical conductors, the mating face extending along the lateral axis; and first and second sidewalls facing in opposite directions and extending between the mating face and the loading surface, each of the first and second sidewalls including a wing member projecting therefrom along the lateral axis and a recess configured to receive a wing member from another terminal block, the wing members and the recesses having matching complementary cross-sections taken along the longitudinal axis such that the wing member on the first sidewall of one terminal block is slidably and securely received within the recess on the second sidewall of another terminal block.

2. The terminal block in accordance with claim 1 wherein the first sidewall of the one terminal block includes a recess that slidably and securely receives a wing member of the second sidewall of the other terminal block.

3. The terminal block in accordance with claim 1 further comprising a mounting side extending between the mating face and the loading surface and configured to interface with a base structure, at least one of the wing members having a surface that is coplanar with the mounting side.

4. The terminal block in accordance with claim 1 wherein the wing members of the first and second sidewalls have respective openings for receiving a fastener.

5. The terminal block in accordance with claim 1 wherein at least one of the first and second sidewalls extends entirely from the mating face to the loading surface.

6. The terminal block in accordance with claim 1 wherein the first and second sidewalls include side surfaces that face in opposite directions, the first and second side surfaces being substantially planar.

7. The terminal block in accordance with claim 1 wherein the wing member and the recess have different axial positions along the longitudinal axis.

8. The terminal block in accordance with claim 7 wherein the different axial positions are directly adjacent to one another.

9. The terminal block in accordance with claim 7 wherein the wing member and the recess have a common axial position along a vertical axis that is perpendicular to the longitudinal axis and the lateral axis.

10. The terminal block in accordance with claim 1 further comprising:

first and second housing shells having first and second coupling sides, respectively, that extend between the mating face and the terminal end, each of the first and second housing shells comprising contact cavities extending from the mating face and along the longitudinal axis, the contact cavities being spaced apart along the lateral axis and configured to receive corresponding electrical conductors, the second housing shell having interior walls extending along the longitudinal axis that separate and define the contact cavities of the second housing shell;

bores extending from the coupling side of the second housing shell and into corresponding interior walls; and locking pins projecting from the coupling side of the first housing shell, wherein the first and second coupling sides mate with each other along an interface when the first and second housing shells are coupled together, the locking pins being inserted into and forming interference fits with corresponding bores, the interference fits combining to form a rigid connection that mechanically holds the first and second housing shells together.

11. The terminal block in accordance with claim 1 further comprising contact cavities extending from the mating face along the longitudinal axis, wherein at least one contact cavity is immediately proximate to the first sidewall.

12. The terminal block in accordance with claim 11 wherein the contact cavities are separated by interior walls having respective thicknesses that extend along the lateral axis, the first sidewall having a thickness that extends along the lateral axis between an exterior of the terminal block and the immediately proximate contact cavity, wherein the thickness of the first sidewall is substantially equal to or less than the thickness separating the immediately proximate contact cavity from an adjacent contact cavity.

13. An electrical terminal block oriented with respect to longitudinal and lateral axes that extend perpendicular to each other, the terminal block comprising:

a mating face and a loading surface being spaced apart from each other along the longitudinal axis and being configured to engage respective electrical conductors, the mating face extending along the lateral axis; and first and second housing shells having first and second coupling sides, respectively, the first and second coupling sides extending between the mating face and the terminal end, each of the first and second housing shells comprising contact cavities extending from the mating face and along the longitudinal axis, the contact cavities being spaced apart along the lateral axis and configured to receive corresponding electrical conductors, the second housing shell having interior walls extending along the longitudinal axis between the contact cavities of the second housing shell;

bores extending from the coupling side of the second housing shell and into corresponding interior walls; and locking pins projecting from the coupling side of the first housing shell, wherein the first and second coupling sides mate with each other along an interface when the first and second housing shells are coupled together, the locking pins being inserted into and forming interference fits with corresponding bores, the interference fits combining to form a rigid connection that mechanically holds the first and second housing shells together.

14. The terminal block in accordance with claim 13 wherein the locking pins are vertically aligned with corresponding contact cavities of the first housing shell such that the locking pins extend directly away from the select contact cavities.

15. The terminal block in accordance with claim 13 wherein the contact cavities of the first housing shell form a first row and the contact cavities of the second housing shell form a second row, the first and second rows being arranged such that the contact cavities of the first row are vertically aligned with the interior walls of the second housing shell.

16. The terminal block in accordance with claim 13 further comprising contact assemblies having contact bodies that extend between the first and second housing shells along the interface and into corresponding contact cavities, the contact bodies forming conductive pathways extending between the mating face and loading surface.

17. The terminal block in accordance with claim 16 wherein the contact assemblies also include spring clips coupled to the contact bodies, the spring clips being held within corresponding contact cavities and being configured to engage and hold electrical conductors against corresponding contact bodies.

18. The terminal block in accordance with claim 16 wherein the contact assemblies also include spring clips coupled to the contact bodies, the spring clips being held within corresponding contact cavities of the first housing shell and flexing into the contact cavities of the second housing shell.

19. The terminal block in accordance with claim 11 further comprising first and second sidewalls facing in opposite directions and extending between the mating face and the loading surface, each of the first and second sidewalls including a wing member projecting therefrom along the lateral axis and a recess configured to receive a wing member from another terminal block, the wing members and the recesses having matching complementary cross-sections taken along the longitudinal axis such that the wing member on the first sidewall of one terminal block is slidably and securely received within the recess on the second sidewall of another terminal block.

* * * * *